US007562741B2

(12) United States Patent
Winklel et al.

(10) Patent No.: US 7,562,741 B2
(45) Date of Patent: Jul. 21, 2009

(54) REAR MUFFLER ASSEMBLY

(75) Inventors: Jörg Winklel, Weissach (DE); Bernd Stadler, Eberdingen (DE)

(73) Assignee: Dr. Ing. h.c. F. Porsche AG, Weissach (DE)

( * ) Notice: Subject to any disclaimer, the term of this patent is extended or adjusted under 35 U.S.C. 154(b) by 0 days.

(21) Appl. No.: 11/867,738

(22) Filed: Oct. 5, 2007

(65) Prior Publication Data

US 2008/0093161 A1 Apr. 24, 2008

(30) Foreign Application Priority Data

Oct. 21, 2006 (DE) ..... 10 2006 049 786

(51) Int. Cl.
*F01N 7/04* (2006.01)
*F01N 1/08* (2006.01)
*F01N 1/02* (2006.01)

(52) U.S. Cl. ..... 181/239; 181/254; 181/272

(58) Field of Classification Search ..... 181/239, 181/238, 253, 254, 268, 269, 272, 275, 232
See application file for complete search history.

(56) References Cited

U.S. PATENT DOCUMENTS 1,280,386 A * 10/1918 Buehner ..... 181/238
1,403,614 A * 1/1922 Malsack ..... 181/254
4,192,401 A * 3/1980 Deaver et al. ..... 181/266
4,360,076 A 11/1982 Suyama
4,589,517 A * 5/1986 Fukuda ..... 181/265
4,598,790 A * 7/1986 Uesugi et al. ..... 181/252
4,665,692 A * 5/1987 Inaba ..... 60/324
4,866,933 A * 9/1989 Kao ..... 60/312
4,913,260 A 4/1990 Fallon
5,014,817 A * 5/1991 Takato et al. ..... 181/254
5,025,890 A * 6/1991 Hisashige et al. ..... 181/272
5,046,977 A * 9/1991 Rodskier ..... 440/89 R
5,325,666 A * 7/1994 Rutschmann ..... 60/302
5,614,699 A * 3/1997 Yashiro et al. ..... 181/254
5,708,237 A * 1/1998 Maeda et al. ..... 181/254
5,723,827 A * 3/1998 Sasaki et al. ..... 181/237
5,723,829 A * 3/1998 Inomata et al. ..... 181/254
5,739,483 A * 4/1998 Yashiro et al. ..... 181/254
5,959,263 A 9/1999 Foltz, Jr.
6,959,782 B2 * 11/2005 Brower et al. ..... 181/272
7,004,283 B2 * 2/2006 Worner et al. ..... 181/239

FOREIGN PATENT DOCUMENTS

DE 2713120 A1 10/1977
DE 3837677 A1 * 6/1989

(Continued)

*Primary Examiner*—Edgardo San Martin

(57) ABSTRACT

A rear muffler assembly for an internal combustion engine has a first and a second muffler through which exhaust gases flow and which are separated from one another. The first and second mufflers have in each case an exhaust gas delivery and discharge through an exhaust gas routing pipe issuing into an exhaust pipe which follows downstream and in which an exhaust gas shutoff flap which can be closed temporarily is disposed. The rear muffler assembly contains two exhaust gas routing pipes, the first exhaust gas routing pipe having within the rear muffler an issue orifice for exhaust gases positively emerging from the second exhaust gas routing pipe, with the exhaust gas shutoff flap closed, into which first exhaust gas routing pipe the exhaust gases from the internal combustion engine flow directly.

10 Claims, 1 Drawing Sheet

FOREIGN PATENT DOCUMENTS

| | | | | |
|---|---|---|---|---|
| DE | 4140429 | A1 | | 6/1993 |
| DE | 19743446 | C2 | | 12/1998 |
| DE | 20120470 | U1 | | 4/2003 |
| EP | 1321639 | A2 | | 6/2003 |
| GB | 2223535 | A | | 4/1990 |
| JP | 03185209 | A | * | 8/1991 |
| JP | 04012145 | A | * | 1/1992 |
| JP | 2001207822 | A | | 8/2001 |
| JP | 2006283644 | A | | 10/2006 |
| WO | 0201049 | A1 | | 1/2002 |

* cited by examiner

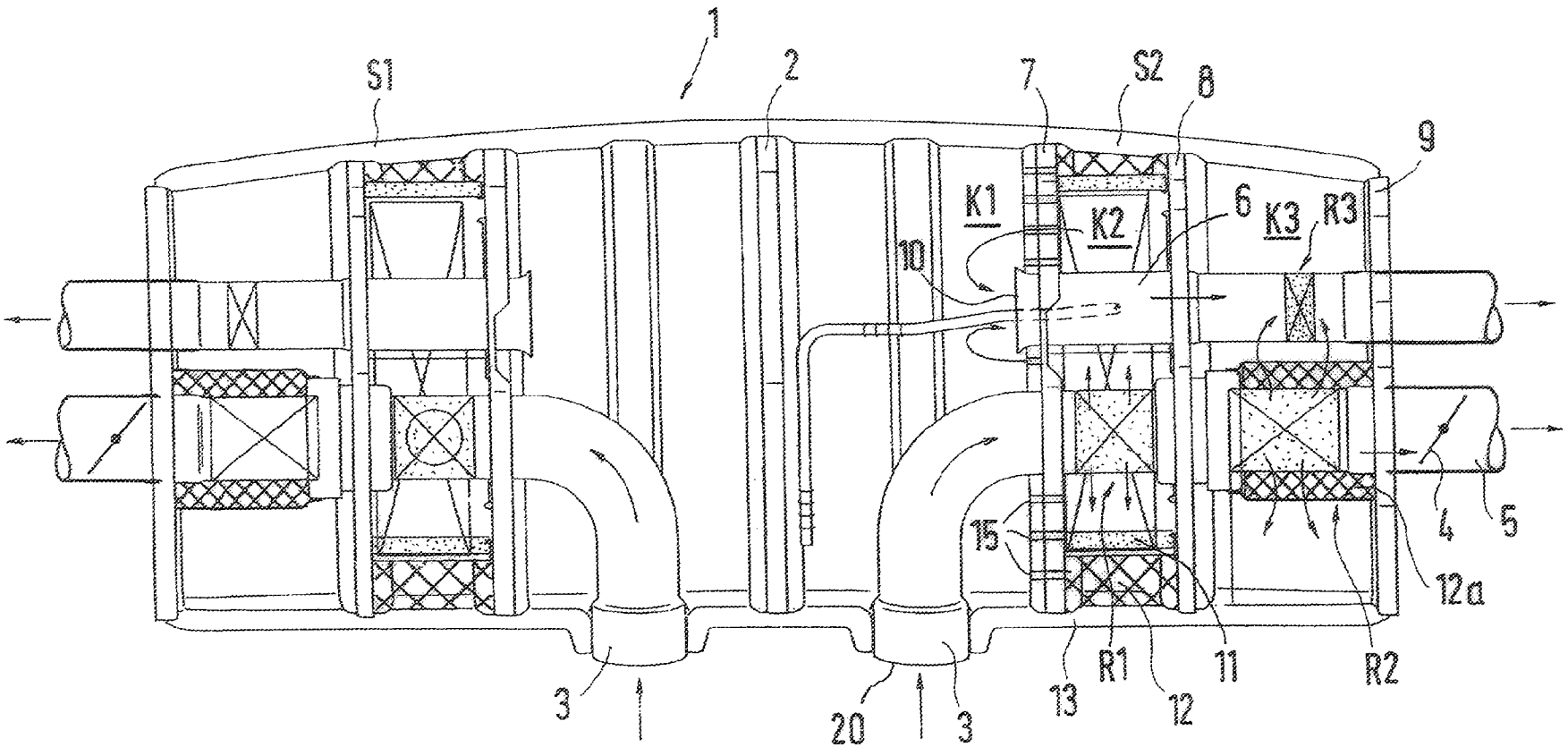
1
2
3
3
4
5
6
7
8
9
10
11
12
12a
13
15
20
R1
R2
R3
K1
K2
K3
S1
S2

REAR MUFFLER ASSEMBLY

CROSS-REFERENCE TO RELATED APPLICATIONS

This application claims the priority, under 35 U.S.C. § 119, of German application DE 10 2006 049 786.4-13, filed Oct. 21, 2006; the prior application is herewith incorporated by reference in its entirety.

BACKGROUND OF THE INVENTION

Field of the Invention

The invention relates to a rear muffler assembly for an internal combustion engine with a first and a second muffler through which exhaust gases flow and which are separated from one another and have in each case an exhaust gas delivery and discharge through an exhaust gas routing pipe issuing into an exhaust pipe which follows downstream and in which an exhaust gas shutoff flap which can be closed temporarily is disposed.

German patent DE 197 43 446 C2 discloses an exhaust system for an internal combustion engine with a rear muffler assembly in which a gas outlet from a second muffler can be temporarily closed and the second muffler serves as a resonator when the gas outlet is closed.

SUMMARY OF THE INVENTION

It is accordingly an object of the invention to provide a rear muffler assembly which overcomes the above-mentioned disadvantages of the prior art devices of this general type, the set-up of which can be produced and assembled in a simple way and which generates a damped or undamped exhaust gas noise in dependence on an exhaust gas flap position.

With the foregoing and other objects in view there is provided, in accordance with the invention, a rear muffler assembly for an internal combustion engine. The rear muffler assembly contains first and second mufflers through which exhaust gases flow and are separated from one another. The first and second mufflers each have an exhaust gas delivery and discharge through an exhaust gas routing pipe assembly issuing into an exhaust pipe which follows downstream. An exhaust gas shutoff flap being temporarily closeable is disposed in the exhaust gas routing pipe assembly. The exhaust gas routing pipe assembly has two exhaust gas routing pipes including a first exhaust gas routing pipe and a second exhaust gas routing pipe. The first exhaust gas routing pipe has an issue orifice for the exhaust gases emerging positively from the second exhaust gas routing pipe with the exhaust gas shutoff flap closed, into the first exhaust gas routing pipe the exhaust gases from the internal combustion engine flow directly.

The advantages mainly achieved by the invention are that, due to the internal set-up of the rear muffler assembly, a desired damped and undamped exhaust gas noise can be generated in drive mode by a closed or open exhaust gas shutoff flap. The noise optimization occurs in that the muffler contains two exhaust gas routing pipes, the first exhaust gas routing pipe having within the muffler an issue orifice for exhaust gases emerging positively from the second exhaust gas routing pipe, with the shutoff flap closed, into which first exhaust gas routing pipe exhaust gases from the internal combustion engine can flow directly.

So that a damped exhaust gas noise can be achieved, with the exhaust gas shutoff flap closed, the second exhaust gas routing pipe is provided, for the discharge of exhaust gases with the shutoff flap closed, with two perforated pipe sections which are disposed in each case in a second and a third chamber of the rear muffler assembly. The then positively deflected exhaust gas stream flows through the perforated pipe sections of the exhaust gas routing pipe in such a way that a first chamber of the rear muffler, in which chamber the issue orifice of the first exhaust gas routing pipe is disposed, has a bottom perforated with holes, toward the second chamber and a perforated sheet metal pot which surrounds the chamber and which is surrounded all round by insulating material. Furthermore, the third chamber following downstream is closed off by bottoms in which a further perforated pipe section of the second exhaust gas routing pipe is disposed and is surrounded directly by an insulating material. The further perforated pipe section of the second exhaust gas routing pipe is disposed, so as to match a perforated pipe section of the first exhaust gas routing pipe, in the third chamber of the rear muffler.

With an exhaust gas shutoff flap closed, the branched-off exhaust gas stream is introduced via one perforated pipe section of the second exhaust gas routing pipe into the issue orifice of the first exhaust gas routing pipe, and the further branched-off exhaust gas stream is introduced via the other perforated pipe section in the third chamber into the perforated pipe section of the first exhaust gas routing pipe.

By the one perforated pipe section of the exhaust gas routing pipe being encased with insulating material, sound insulation is achieved. Via the insulating material surrounding the sheet metal pot, both sound absorption and heat protection are achieved in such a way that no scorching of the rear muffler or of the pot occurs.

Other features which are considered as characteristic for the invention are set forth in the appended claims.

Although the invention is illustrated and described herein as embodied in a rear muffler assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

The single FIGURE of the drawing is a diagrammatic, sectional view through a rear muffler assembly with the two exhaust gas routing pipes and with the individual chambers according to the invention.

DETAILED DESCRIPTION OF THE INVENTION

Referring now to the single FIGURE of the drawing in detail, therein is shown a rear muffler assembly 1 containing two mufflers S1 and S2 which are disposed so as to be separated from one another via a closed bottom 2 and which have an identical set-up, so that only one muffler is described.

The exhaust gas routing pipe 3 of the rear muffler are connected in each case to a non-illustrated exhaust gas connection of an internal combustion engine. The exhaust gases are conducted in the direction of the arrows through exhaust gas routing pipes 3 and, depending on the position of an exhaust gas shutoff flap 4 in an exhaust pipe 5, through a further exhaust gas routing pipe 6.

The exhaust gas routing pipes 6 and 3 are generally held within the rear muffler assembly 1 in bottoms (partitions) 7, 8, 9 which subdivide the chambers K1, K2 and K3. The first exhaust gas routing pipe 6 has an inner issue orifice 10 which lies in the chamber K1, extends through the two adjoining chambers K2 and K3 and issues outward.

The second exhaust gas routing pipe 3 extends from an outer issue orifice 20 through the chambers K1, K2 and K3 and likewise issues outward into the exhaust pipe 5 associated with the internal exhaust gas shutoff flap 4.

The second exhaust gas routing pipe 3 has in the second chamber K2 a pipe region R1, which is perforated, that is to say is provided with holes, and which is surrounded by a perforated sheet metal cage 11. The latter is covered all round with material 12 which extends as far as a shell 13 of the rear muffler assembly 1. A clearance is provided between the perforated pipe region R1 and the sheet metal cage 11. A following pipe region R2 of the exhaust gas routing pipe 3 is perforated, that is to say, is configured with holes which are surrounded directly by insulating material 12*a*. Matching the pipe region R2, a pipe region R3 of the first exhaust gas routing pipe 6 is perforated, that is say provided with holes, in the same chamber K3.

With the exhaust gas shutoff flap 4 open, the exhaust gases from the internal combustion engine can flow, undamped, outward through the exhaust gas routing pipes 3 and 6. By contrast, with the exhaust gas shutoff flap 4 closed, the exhaust gases flow positively only via the perforated pipe sections R1 and R2 of the second exhaust gas routing pipe 3, on the one hand, through the partition 7, provided with holes 15, between the two chambers K1 and K2 to the issue orifice 10 and, on the other hand, through the perforated pipe section R3 of the first exhaust pipe 6. A damped exhaust gas noise simultaneously occurs via the outflow of the exhaust gases through the insulating material 12, 12*a*.

The invention claimed is;

1. A rear muffler assembly for an internal combustion engine, the rear muffler assembly comprising:

first and second mufflers through which exhaust gases flow and which are separated from one another;

each of said first and second mufflers including:

an exhaust gas routing pipe assembly for exhaust gas delivery and discharge to an exhaust pipe which follows downstream, said exhaust gas routing pipe assembly extending through a first chamber, a second chamber and a third chamber;

said exhaust gas routing pipe assembly including a first exhaust gas routing pipe and a second exhaust gas routing pipe;

said first exhaust gas routing pipe including an issue orifice and a first perforated pipe section;

said second exhaust gas routing pipe including a second perforated pipe section disposed in said second chamber and a third perforated pipe section disposed in said third chamber;

a temporarily closeable exhaust gas shutoff flap in communication with said exhaust gas routing pipe assembly so as to form, when closed:

a first branched-off exhaust gas stream positively discharged from said second perforated pipe section of said second exhaust gas routing pipe flowing into said issue orifice of said first exhaust gas routing pipe; and a second branched-off exhaust gas stream positively discharged from said third perforated pipe section in said third chamber flowing into the first perforated pipe section of said first exhaust gas routing pipe.

2. The rear muffler assembly according to claim 1, wherein said first chamber contains said issue orifice of said first exhaust gas routing pipe, said first chamber having a partition formed with perforated holes therein, oriented toward said second chamber;

the rear muffler assembly further including a perforated sheet metal pot surrounding said second chamber and an insulting material surrounding said perforated sheet metal pot.

3. The rear muffler assembly according to claim 2, wherein:

said third chamber follows downstream of said second chamber and has partitions closing said third chamber; and said third perforated pipe section of said second exhaust gas routing pipe is has an insulating material surrounding said third perforated pipe section.

4. The rear muffler assembly according to claim 3, wherein:

said first perforated pipe section is disposed in said third chamber; and said third perforated pipe section of said second exhaust gas routing pipe is disposed matching said first perforated pipe section in said third chamber.

5. The rear muffler assembly according to claim 1, wherein:

said third chamber follows downstream of said second chamber and has partitions closing said third chamber; and said third perforated pipe section of said second exhaust gas routing pipe is disposed in said third chamber and has an insulating material surrounding said third perforated pipe section.

6. A rear muffler assembly for an internal combustion engine, the rear muffler assembly comprising:

first and second mufflers through which exhaust gases flow and which are separated from one another;

each of said first and second mufflers including:

an exhaust gas routing pipe assembly for exhaust gas delivery and discharge to an exhaust pipe which follows downstream, said exhaust gas routing pipe assembly extending through a first chamber, a second chamber and a third chamber;

said exhaust gas routing pipe assembly including a first exhaust gas routing pipe and a second exhaust gas routing pipe;

said first exhaust gas routing pipe including an issue orifice and a first perforated pipe section, said first perforated pipe section being disposed entirely in said third chamber;

said second exhaust gas routing pipe including a second perforated pipe section disposed entirely in said second chamber and a third perforated pipe section disposed entirely in said third chamber;

a temporarily closeable exhaust gas shutoff flap in communication with said exhaust gas routing pipe assembly so as to form, when closed:

a first branched-off exhaust gas stream positively discharged from said second perforated pipe section into said issue orifice; and a second branched-off exhaust gas stream positively discharged from said third perforated pipe section into said first perforated pipe.

7. The rear muffler assembly according to claim 6, wherein said first chamber contains said issue orifice of said first exhaust gas routing pipe, said first chamber having a partition formed with perforated holes therein, oriented toward said second chamber;

the rear muffler assembly further including a perforated sheet metal pot surrounding said second chamber and an insulting material surrounding said perforated sheet metal pot.

8. The rear muffler assembly according to claim 7, wherein:

said third chamber follows downstream of said second chamber and has partitions closing said third chamber; and said third perforated pipe section of said second exhaust gas routing pipe has an insulating material surrounding said third perforated pipe section.

9. The rear muffler assembly according to claim 8, wherein said third perforated pipe section is disposed in said third chamber matching said first perforated pipe section.

10. The rear muffler assembly according to claim 6, wherein:

said third chamber follows downstream of said second chamber and has partitions closing said third chamber; and said third perforated pipe section of said second exhaust gas routing pipe has an insulating material surrounding said third perforated pipe section.

* * * * *